US005964169A

United States Patent [19]

Kongo et al.

[11] Patent Number: 5,964,169

[45] Date of Patent: Oct. 12, 1999

[54] EMBROIDERY STITCH DATA PRODUCING DEVICE

[75] Inventors: Takeshi Kongo; Takayuki Kawasato; Akira Orii; Shinichi Hukada, all of Hachioji, Japan

[73] Assignee: Janome Sewing Machine Co., Ltd., Tokyo, Japan

[21] Appl. No.: 09/131,266

[22] Filed: Aug. 7, 1998

[30] Foreign Application Priority Data

Sep. 3, 1997 [JP] Japan ..... 9-252640
Oct. 24, 1997 [JP] Japan ..... 9-309562

[51] Int. Cl.[6] ..... D05C 5/06

[52] U.S. Cl. ..... 112/102.5; 112/445; 112/470.04

[58] Field of Search ..... 112/102.5, 470.06, 112/445, 453, 454, 456, 458, 470.04; 364/470.09, 470.07

[56] References Cited

U.S. PATENT DOCUMENTS 4,869,188 9/1989 Hyodo ..... 112/445
5,386,789 2/1995 Futamura et al. ..... 112/102.5
5,494,552 2/1996 Owaki ..... 112/102.5
5,740,057 4/1998 Futamura ..... 112/102.5 X

*Primary Examiner*—Peter Nerbun
*Attorney, Agent, or Firm*—Nields, Lemack & Dingman

[57] ABSTRACT

An embroidery stitch data producing device is disclosed, which is designed to display an embroidery pattern in a manner that the pattern is closest to the one that is to be embroidered. The device is provided with a scanner 51 or an image input means 2 for inputting colors therethrough. The color indicating data thus obtained and/or color indicating data stored in an image data memory 41 are registered to a color indication data registering means 22. More particularly the area of a display may be set for the background of an image to be embroidered before or after the image is displayed, or before or after the stitch conditions including thread colors are set.

12 Claims, 8 Drawing Sheets

| Blocks | Thread colors/stitch types | Groups of blocks |
|---|---|---|
| Roof 80 | Red/horizontal | A |
| Wall 81 | Blue/oblique | B |
| Window 82 | Yellow/cross | C |
| Window 83 | Yellow/cross | |
| Outlines 90~95 | Black/zigzag/2mm | D |
| Outlines 96~100 | Blue/straight/2mm | E |

EMBROIDERY STITCH DATA PRODUCING DEVICE

BACKGROUND OF THE INVENTION AND RELATED ART STATEMENT

The invention relates to a device for producing embroidery stitch data to be used to form embroidery stitches particularly by means of a computerized sewing machine.

It has been of usual practice that the maker of the embroidery stitch data producing device makes up and supplies the embroidery stitch data to the user so that the user may use such embroidery stitch data with a sewing machine capable of producing embroidery stitches or with an embroidering machine.

However it has become more conspicuous that the user himself or herself desires to make images as he or she pleases to represent the images in the embroidery stitches. Actually a device is now on sale in the market, which is provided with an image sensor to read the original image depicted on a paper by the user to thereby make the embroidery stitch data therefrom.

However such embroidery data producing device now on sale fails to produce the stitch data of image and designate thread colors in reference to the color of the work or cloth on which the image is sewn. More particularly, although such embroidery data producing device is provided with a function to display the images, but fails to display the color of background of the images. Therefore the user can not foresee the balance between the colors of image and the color of the work on which the image is sewn before the image is actually embroidered. It is particularly desirable that the image to be finished up is displayed beforehand as exactly as possible especially with the colors of threads which may be used by the user for embroidering the image, so that the user may precedingly determine the colors of the image to be stitched.

The present invention has been provided to attain such a desire of the user.

SUMMARY OF THE INVENTION

The embroidery stitch data producing device of the invention for producing stitch data on the basis of given image information substantially comprises display means for indicating thereat an image in connection with image information; means for setting a background area of an image at the display means; and display control means for controlling the display means to indicate thereat the background area with a given color. Thus if the background is displayed with the color closest to the color of the work on which an image is sewn, the user will be able to foresee the embroidering effects before the embroidering operation is started.

The background area may be set before or after the image is displayed. In case the background area is set after the image is displayed, the display area other than the area of image may be designated for the background area. In case the background area is set before the image is displayed, the indication of the image may reset the part of the precedingly set background area corresponding to the area of image as is indicated.

Further the background area may be optionally set by the user, for example, by designating the indicated image as the background to make the image area void.

It is desirable that the color of background may be optionally designated.

Further the embroidery stitch data producing device of the invention may comprise means for enabling the user to register optional colors so that the registered colors may be selectively designated.

If the user registers the color indicating data corresponding to the colors of clothes and threads, the registered color data may be selectively designated to indicate them at the display so that the user may foresee the colors of image to be stitched up.

Further the embroidery stitch data producing device of the invention may comprise means for producing optional color indicating data corresponding to the colors of cloths and threads so that these colors may be registered.

Further the embroidery stitch data producing device of the invention may comprise means including a scanner, or a digital camera having CCD for reading in optional colors so that these colors data may be registered.

Further the embroidery stitch data producing device of the invention may comprise memory means for storing therein predetermined color indicating data which may be read out by addressing them by means of the corresponding numbers.

DETAILED DESCRIPTION OF PREFERRED EMBODIMENT

The preferred embodiment of the invention will now be described in reference to the attached drawings.

Figure 1:
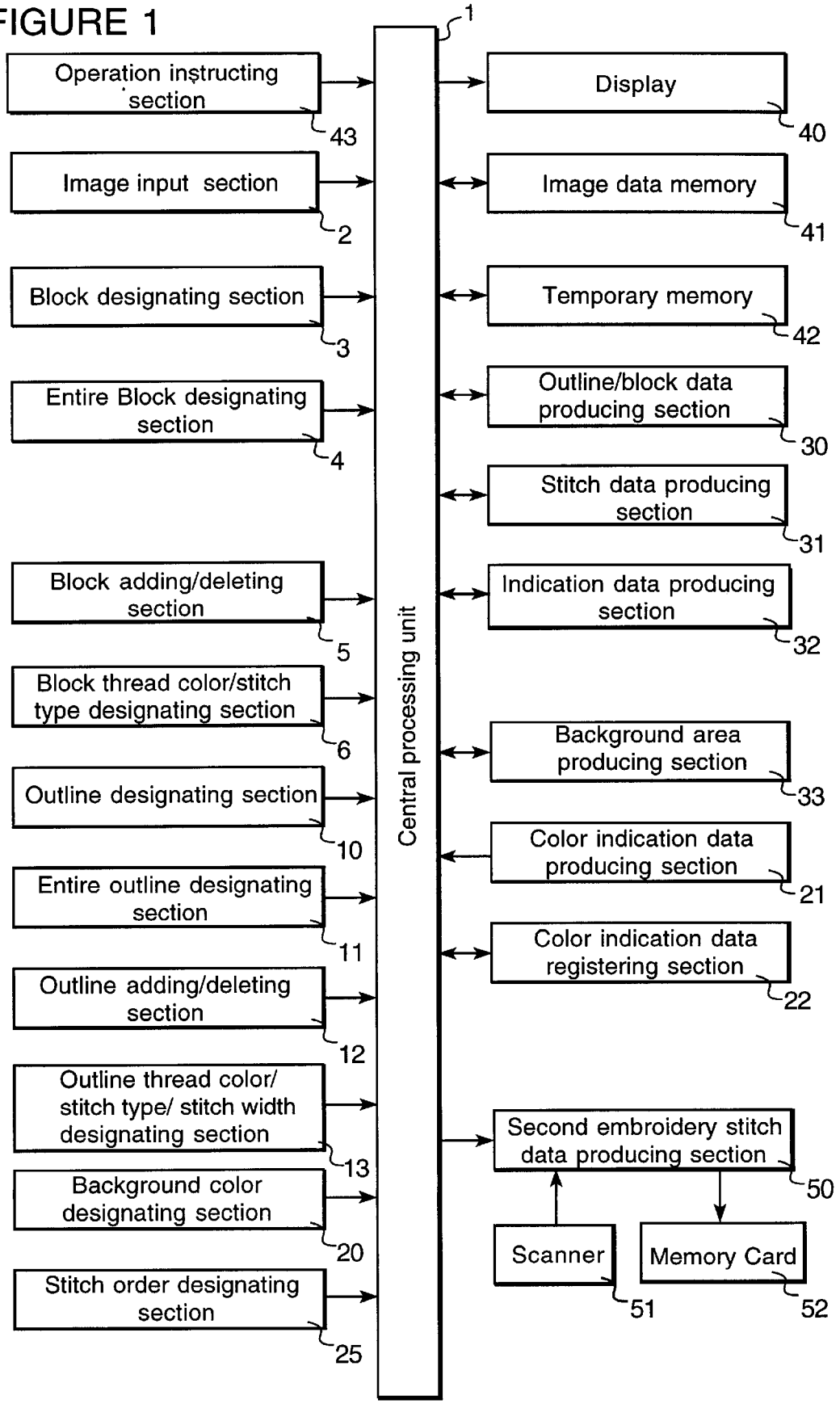
FIG. 1 is a detailed block diagram showing the functions of an embodiment of the invention.
Figure 8:
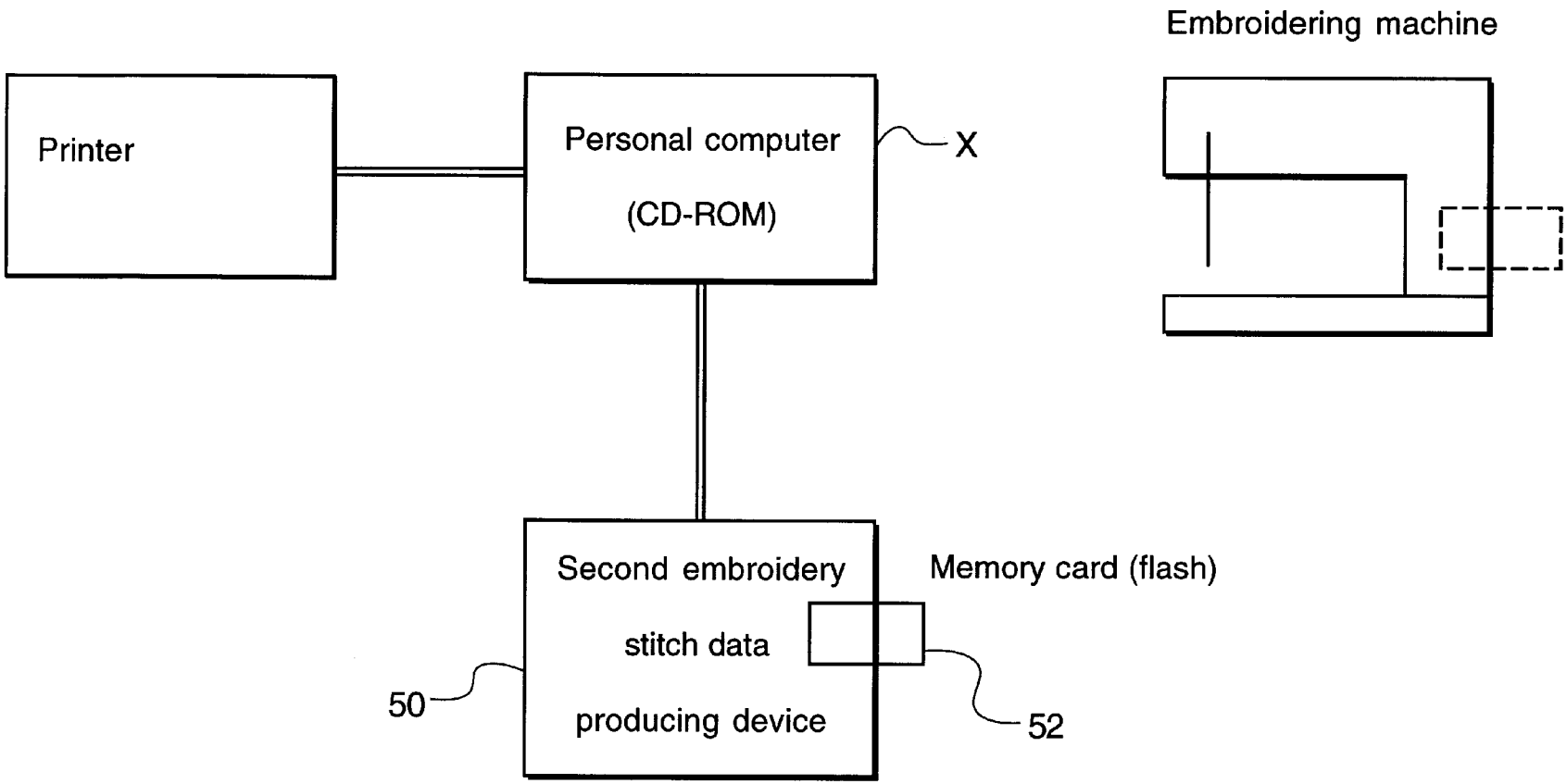
FIG. 8 is a block diagram showing the system of the invention including a peripheral device to be used in combination with the system.

FIG. 8 shows the system of the embroidery data producing device X according to the invention including peripheral apparatuses to be used in connection with the device. In this system, the embroidery data producing device X comprises a personal computer having a memory such as a CD-ROM or the like having specific programs stored therein. The embroidery data producing device X is adapted to be connected to a second embroidery data producing device 50 which may be obtained in the market. As shown in FIG. 1, the second embroidery data producing device 50 has a scanner 51 for reading an original image thereat to make stitch data from the image to be stored in a memory card 52. This function of the second embroidery stitch data producing device 50, particularly the function of storing the stitch data as produced into the memory card 52, is utilized in the embroidery data producing device X. It is, of course, possible to provide this function in the embroidery data producing device X itself.

The memory card 52 as having the stitch data stored therein is adapted to be attached to an embroidery stitching sewing machine to make the embroidery stitches.

The embroidery data producing device X has a printer connected thereto, which is operated to print out the stitches which may be produced by means of the stitch data stored in the memory card for confirmation prior to actual stitching.

Figure 2:
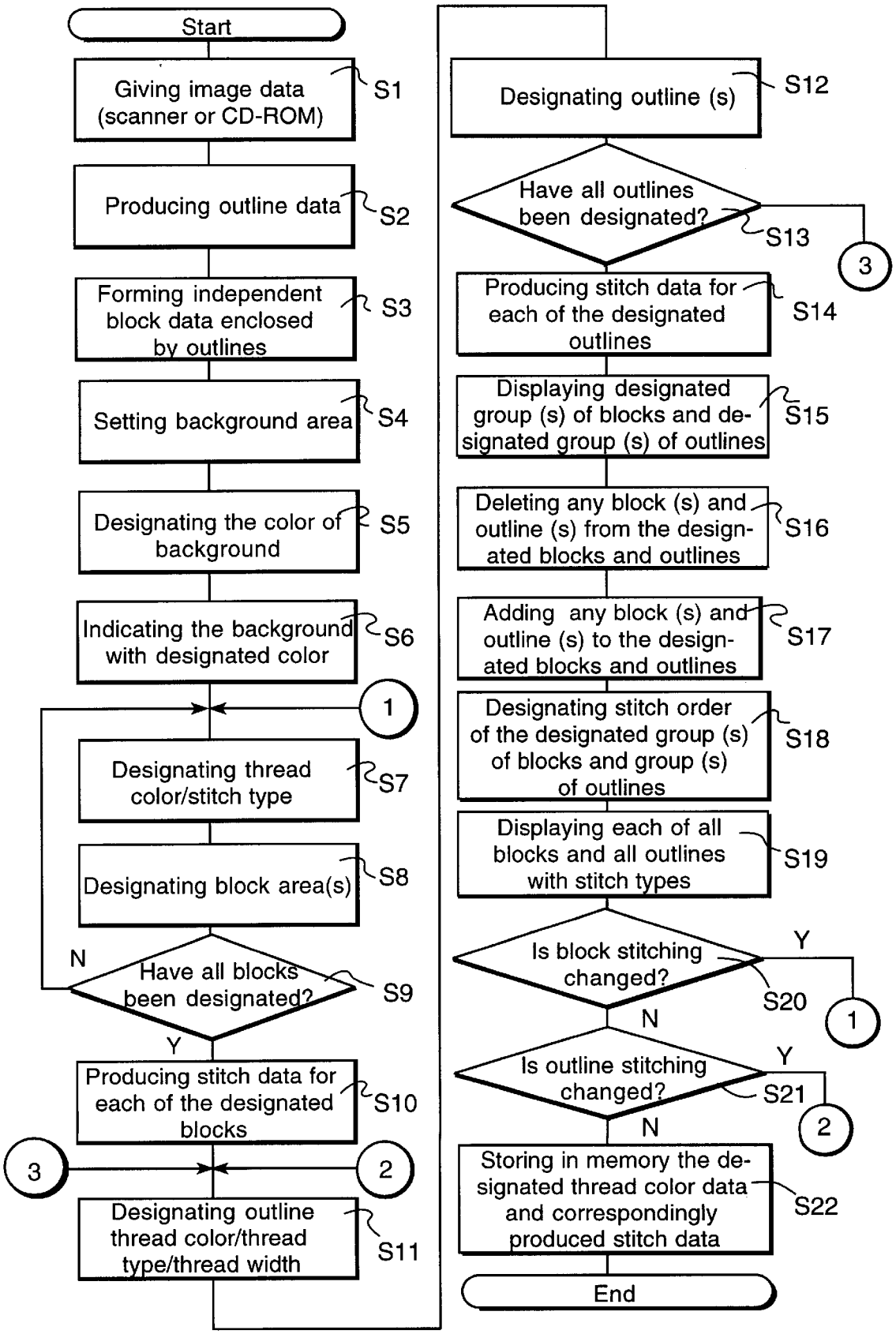
FIG. 2 is a flow chart showing the operation sequences of the embodiment of the invention.

FIG. 1 shows the details of the embroidery data producing device X in the form of blocks, that is, a personal computer comprising various software. FIG. 2 shows a flow chart indicating the sequence of operation steps of the device.

Now in reference to FIGS. 1 and 2, a central processing unit 1 is a capital control section which is operated in response to the instructions from an operation instructing section 43 to control various functions. An image input section 2 is provided to input the image data in the form of bit-map data into the memory such as CD or FD thereof. This may be replaced by the scanner 51 as shown in FIG. 2. The image data may be previously stored in an image data memory 41.

Figure 3:
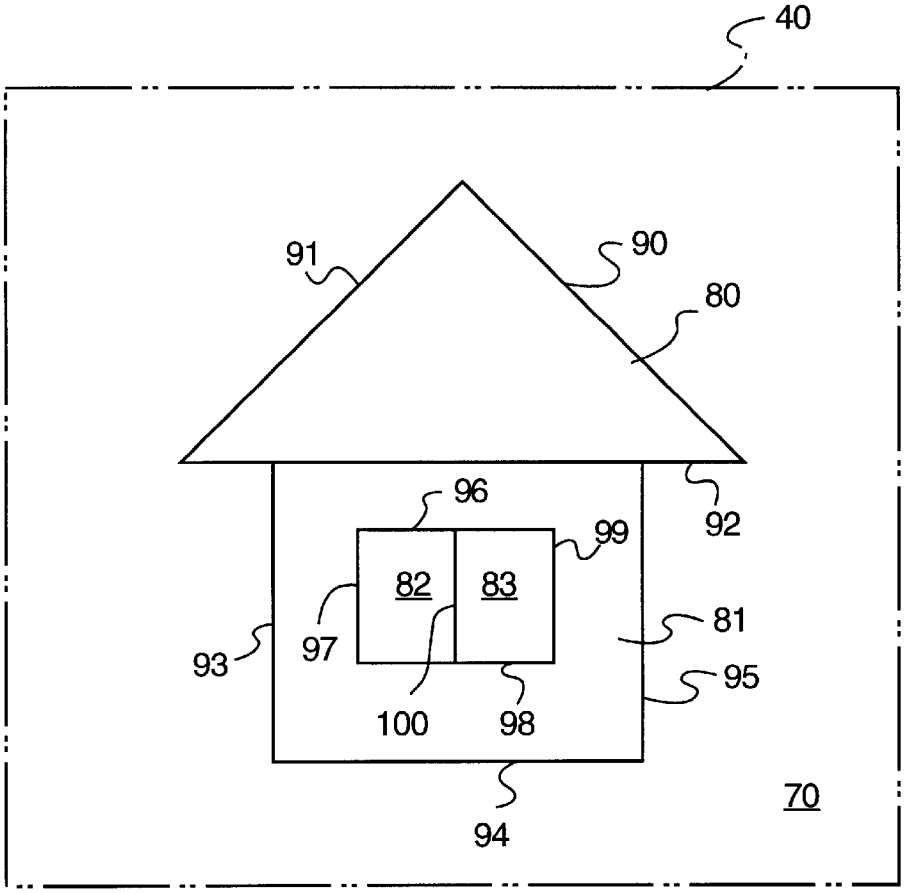
FIG. 3 is an explanatory representation of the embodiment of the invention showing an image divided into blocks enclosed by outlines to be sequentially stitched according to the embodiment of the invention.

The image data read out from the image input section 2 or the image data memory 41 are stored in a temporary memory 42 and then converted into outline data and block data by an outline/block data producing section 30 (Steps S 1,2,3). If the image representing the configuration of a house as shown in FIG. 3 is inputted, the image is defined by the outlines 90~100 and by the blocks 80~83 enclosed by the outlines in the method as is generally known. The outlines 90~100 are divided at the intersections.

The image data including the data for the outlines and blocks are stored in the temporary memory 42. Subsequently the user is required to set an area of background (Step S4), and then designate a color of the background area (Step 5), thereby to indicate the background area with the designated color at the display (Step 6).

Namely a background color designating section 20 is operated to designate the background area and the color thereof which may be displayed or printed out. A background area producing section 33 is responsive to operation of the background color designating section 20 to acknowledge as the background area 70 the place of the display 40 which is designated by the background color designating section 20. The background area 70 is simultaneously displayed with the designated color.

The designation of the background area and the simultaneous display of the color may be done after the image is displayed or after the stitch conditions are set. In this case, all areas of display 40 other than the area of image are acknowledged as the background area 70. Similarly all areas of display 40 other than the areas of designated blocks and outlines of image are acknowledged as the background area 70.

Further the background may be optionally designated by the user. In this case, the user may designate the area of image as the background, thereby to make the image area void.

Thus the user may foresee the relation between the color of work and the colors of image which is sewn on the work.

FIG. 3 shows the image indicated at the display 40 after the color of background has been displayed.

The user may register to a color indication data registering section 22 the date for indicating optional colors. The color indicating data my be produced by a color data producing section 21, or may be read out from an image data memory 41 which stores therein a palette having various colors. Alternatively the scanner 51 may be used to read in the existing colors so that these colors may be registered as the color indicating data. The existing colors may be read in from the image input section 2 by means of CD, FD or a digital camera so that these colors may be registered to the color indication data registering section 22 as the color indicating data.

Subsequently the user may determine the embroidering conditions as to the thread colors and the types of stitches of the outlines and the blocks while looking at the image indicated at the display 40. At first, a block thread color/stitch type designating section 6 is operated to designate the block thread colors and the stitch types (Step S7). Particularly the thread colors and the stitch types are optionally and simultaneously selected from the predetermined colors such as red, blue, yellow and so on, and the predetermined stitch types such as horizontal stitches, vertical stitches, inclined stitches, cross stitches and so on which have the colors as mentioned respectively.

The thread colors may be read out from the color indication data registering section 22 to which the corresponding thread color data are registered.

After the thread color and the stitch type have been selected by operation of the block thread color/stitch type designating section 6, a block designating section 3 is operated to select the blocks to which the selected stitch types having the selected thread colors are applied (Step S8). As shown in FIG. 3, the blocks 80,81,82,83 are optionally designated to have the selected stitch types of selected colors applied thereto respectively. The blocks thus designated are each regarded and dealt with as so many units. More particularly, provided that the image of house as shown in FIG. 3 is stitched with a plurality of stitch colors, the productions of stitch types and accordingly of the stitch colors are regarded and dealt with as being occurred in so many units. This will enable the user to accomplish the embroidering operation with a minimum number of times of exchanging the stitch thread as required during the embroidering operation.

FIG. 3 further shows a table by way of example indicating the relations between the embroidering conditions and the designate blocks. In the table, the blocks 82 and 83 are designated continuously with the same conditions, and therefore dealt with one block group C.

Upon all of the blocks have been designated by operation of the block thread color/stitch type designating section 6 (Step S9), the stitch data will be produced for the designated blocks A, B and C respectively (Step S10). The stitch data as produced will include the stitch data for forming the initial and/or last finish (or loose-preventing ) stitches for each of the blocks. If the a first block and a second block are continuous, the initial finish stitch data may be not required for the second block.

The stitch data may be produced by a stitch data producing section 31. The stitch data as produced are simultaneously processed by an indication data producing section 32 so as to be indicate at the display 40 as the indication data.

In addition to the block designating section 3, an entire block designating section 4 and a block adding /deleting section 5 are provided to increase the operation efficiency of the illustrated device. The entire block designating section 4 may be operated to designate all of the blocks at one time.

In this case, all the blocks will be stitched with one designated stitch type, and accordingly of one designated thread color without requirement of designating the blocks one after another.

The block adding /deleting section 5 may be operated to add a new block or blocks, or delete any block or blocks to and from the once designated block group. It is, therefore, possible that the entire block designating section 4 is operated first to designate all of the blocks, and then the block adding /deleting section 5 is operated to add or delete any block or blocks to and from the first designated entire blocks.

Subsequently the user may determine the embroidering conditions including the colors, the stitch types and the stitch widths of the image outlines while looking at the image indicated at the display 40. More particularly an outline color/stitch type/stitch width designating section is operated to designate the thread colors, the stitch types and the stitch widths of the image outlines (Step 11). The thread colors may be optionally selected, for example, from red, blue, yellow and so on. The stitch types may be optionally selected, for example, from zigzag stitches, straight stitches and so on. The stitch widths may be optionally selected, for example, from 2 mm, 3 mm and so on.

Subsequently an outline designating section 10 is operated to designate the outlines of the image to which the thread colors, the stitch types and the stitch widths are applied (Step S12). More particularly as shown in FIG. 3, for example, such outlines are selected from the outlines 90~100 of the image. The selected group or groups of outlines may be dealt with as a single unit, and the stitch data are produced in a single unit, and the embroider stitching is conducted in a single unit, that is, in succession. It is, therefore, apparent that the number of thread changing times may be reduced to a minimum.

In the table in FIG. 3, the outlines 90~95 are designated with black thread/zigzag stitches/stitch width 2 mm while the outlines 96~100 are designated with blue thread/straight stitches/stitch width 2 mm. Therefore, the group of outlines 90~95 and the group of outlines 96~100 are dealt with as so many units, that is, two units D and E.

After all of the outlines have been designated (Step S13), the stitch data are produced for the outline groups D and E respectively in accordance with the designations as shown in FIG. 3 (Step S14). In case the outlines are separated from each other, the stitch data as are produced will include the stitch data for forming at least the initial or last finish or loose-preventing stitches for the respective separated outlines.

The stitch data are produced by the stitch data producing section 31 and simultaneously the indicating data are produced by the indicating data producing section 32 in accordance with the stitch data. The indicating data are indicated at the display 40.

In addition to the outline designating section 10, this embodiment has an entire outline designating section 11 and an outline adding /deleting section 12 provided therewith for increasing the operation efficiency of the device. The entire outline designating section 11 is operated to designate the entire outlines when all blocks are stitched with a same color, a same stitch type and a same stitch width. In this case, it is not required to designate each of the outlines one after another.

The outline adding/deleting section 12 is operated to optionally add a new outline or outlines to the group of outlines which have been designated, or to optionally delete one or more outlines from the group of outlines which have been designated. It will be convenient to use the outline adding /deleting section 12 after the entire outline designating section 11 has been operated.

When the blocks and the outlines are designated in accordance with the embroidery conditions as mentioned above, the designated group of blocks and the designated group of outlines are indicated at the display 40 (Step S15). At this step, it is further possible to optionally add or delete a block or blocks and /or a outline or outlines to and from the group of blocks and /or the group of outlines which have been designated (Steps S16, S17).

As described above, according to the embodiment, the blocks and the outlines are designated by the different sections respectively, and will not be stitched in succession as a single unit if the blocks and the outlines are designated with a same thread color or another embroidery condition.

This embodiment has been described as having the group of blocks and the group of outlines firstly designated with the same embroidery conditions, and then optionally re-designated with manual operations by the user. It is, however, possible to automatically divide the blocks with discrimination of the thread cookers as designated to the blocks and the outlines. In this case, it is desirable that the designated blocks and outlines should not be dealt with as a single unit even if the blocks and outlines are stitched with a same thread color.

The stitching order of the group of blocks and the group of outlines are determined by operation of a stitch order designating section 25, wherein the blocks may be firstly stitched and subsequently the outlines may be stitched and vice versa. Further the stitching order of the blocks and the outlines may be optionally determined (Step S18).

All of the blocks and outlines as designated are indicated at the display 40 so that the blocks and outlines may be acknowledged by the user (Step S19).

Subsequently if the stitch conditions of blocks and outlines are not changed (Steps S20, S21), the produced stitch data are stored in the memory card 52 together with the thread colors (Step S22). The memory card 52 is attached to the embroidering machine as shown in FIG. 8, thereby to control the operations of the machine for embroidery stitching. Since the stitch data are classified in accordance to the group(s) of blocks and the group(s) of outlines designated by the user, the embroidery stitching may be carried out with a minimum number of thread changing times.

Figure 4:
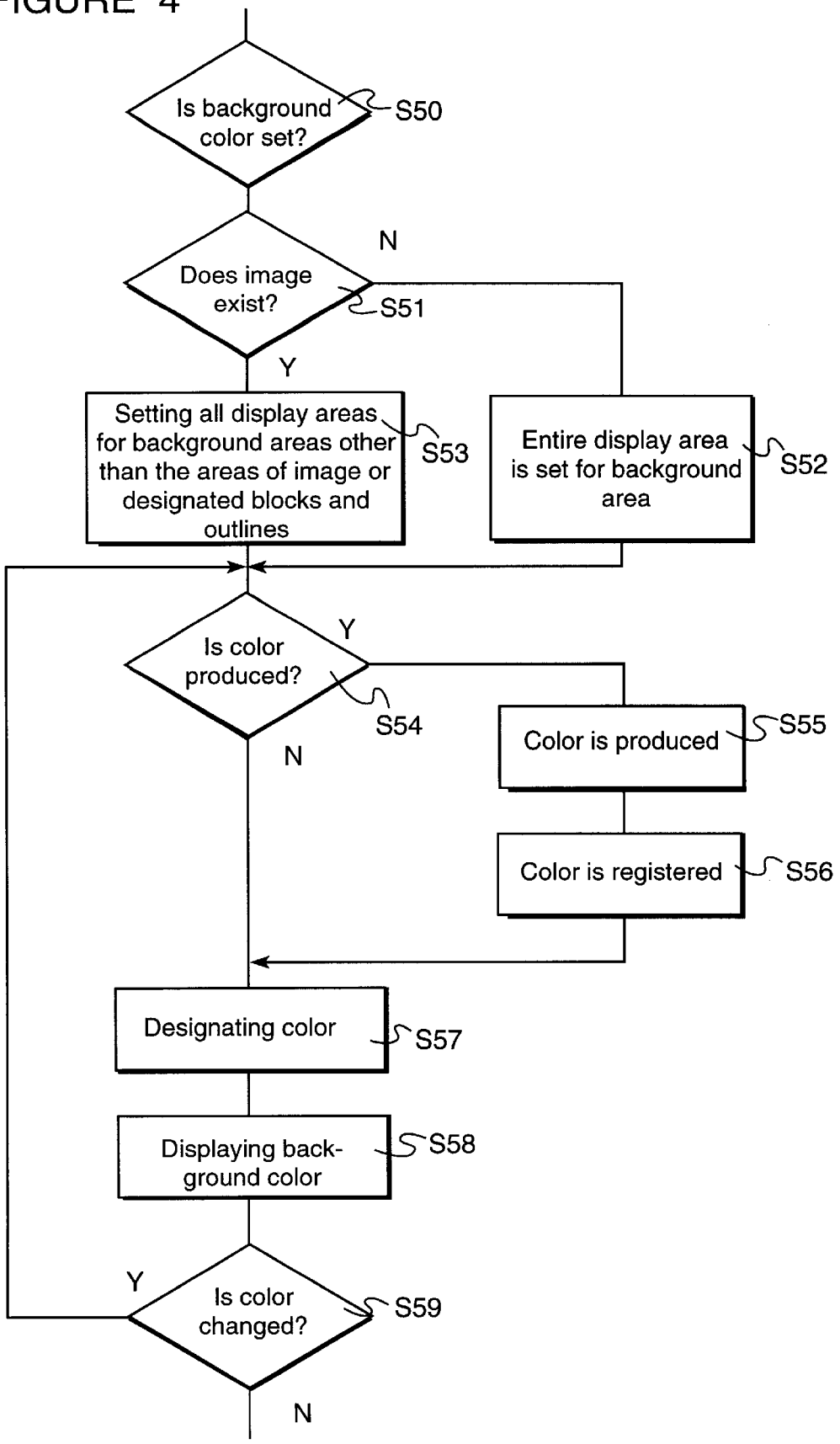
FIG. 4 is a flow chart showing the operations for setting the background area of an image and for designating thread colors according to the embodiment of the invention.

The operations will be described for setting the background area and displaying the same in reference to FIG. 4.

When the background color designating section 20 is operated (Step S50), it is discriminated if an image exists or not at the display 40 (Step S51). If the image does not exist, the entire area of the display 40 is set for the background (Step S52). On the other hand, if the image exists, the area(s) of the display 40 other than the area occupied by the image or the blocks and outlines of the image is set for the background (Step S53). If a designated color is to be produced (Step S54), the color is produced by the color indication data producing section 21 (Step S55). Subsequently the color is registered (Step S56).

Then the color is selected from the colors of the color palette, or is selected from those registered (Step S57), and then the color is indicated at the display 40 (Step S58). If the color is to be changed, the step is returned to the step S54 (Step S59).

Thus the user is able to foresee at the display 40 the color which is closest to the color of the work on which an image is sewn, and further in combination with an image to be subsequently displayed.

Figure 5:
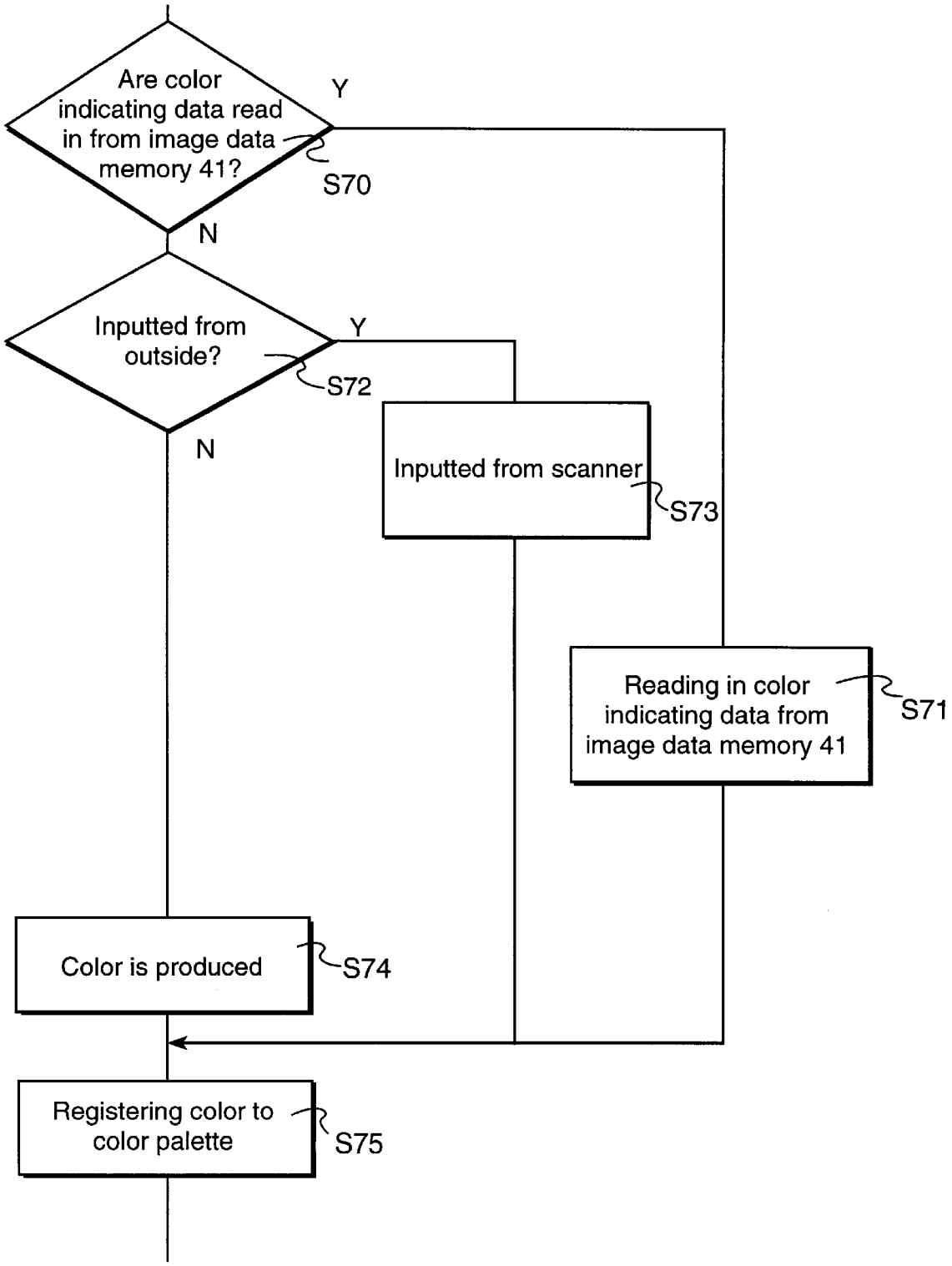
FIG. 5 is a flow chart showing the operations for registering the thread colors according to the embodiment of the invention.

Further according to the invention, not only the background color but also the colors of threads to be used for embroidery stitching may be produced and registered as described hereinbefore. This will be described in reference to FIG. 5.

If the color indicating data are read in from the image data memory 41(Step S70), the color indicating data are read in with color numbers being designated thereto from the image data memory 41(Step S71) and then are registered to the color indication data registering section 22 (Step S75). If the color indicating data are inputted from outside (Step S72), the colors are inputted from the scanner (Step S73) and the corresponding color indicating data are registered to the color indication data registering section 22 (Step S75). If the colors are not inputted from outside, the color indicating data are produced by the color indication data producing section 21 (Step S74), and the data are registered to the color indication data registering section 22 (Step S75).

Thus the user is able to register the data for the colors which are same or closest to the colors of clothes and threads to be actually employed, and further to display the image so that the user may foresee the embroidering effects as to colors before the stitching operation is started.

Figure 6:
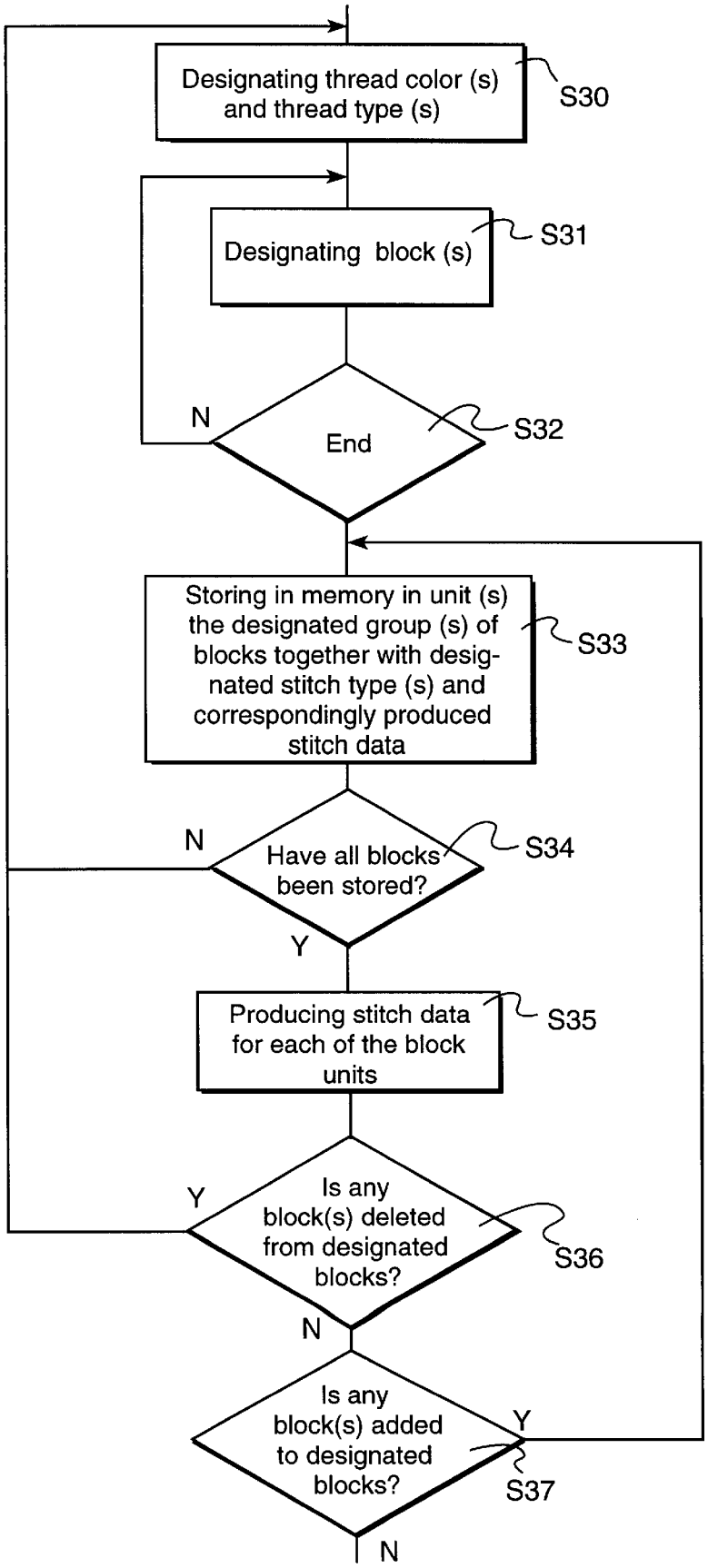
FIG. 6 is a flow chart showing the operations for setting stitch conditions and designating the blocks of image according to the embodiment of the invention.

The operations of block designations at steps S7 to 10 and steps S16 and S17 FIG. 2 will now be described in reference to FIG. 6.

When the block thread color/stitch type designating section 6 is operated to designate the embroidery conditions of block thread color and stitch type (Step S30), the block designating section 3 is operated to designate the block of the embroidery conditions (Step S31). When the designation by the block designating section 3 is finished (Step S32), the designated group of blocks is temporally stored together with the thread color and the stitch type (Step S33). When the designation of all blocks is finished with repetition of the same operations (Step S34), the stitch data are produced corresponding to the groups of blocks respectively (Step S35).

If the block adding/deleting section 5 is operated to delete any embroidery conditions of a block or blocks from the already designated embroidery conditions of blocks, the step is returned to the step S30, where the already designated embroidery conditions of blocks are so reset (Step S36). On the other hand, if the section 5 is operated to add any embroidery conditions of a block or blocks to the already designated embroidery conditions of blocks, the step is returned to the step S33, where the already designated embroidery conditions of blocks are so reset, and then the stitch data are produced for the finally designated embroidery conditions of the groups of blocks (Step S37).

Figure 7:
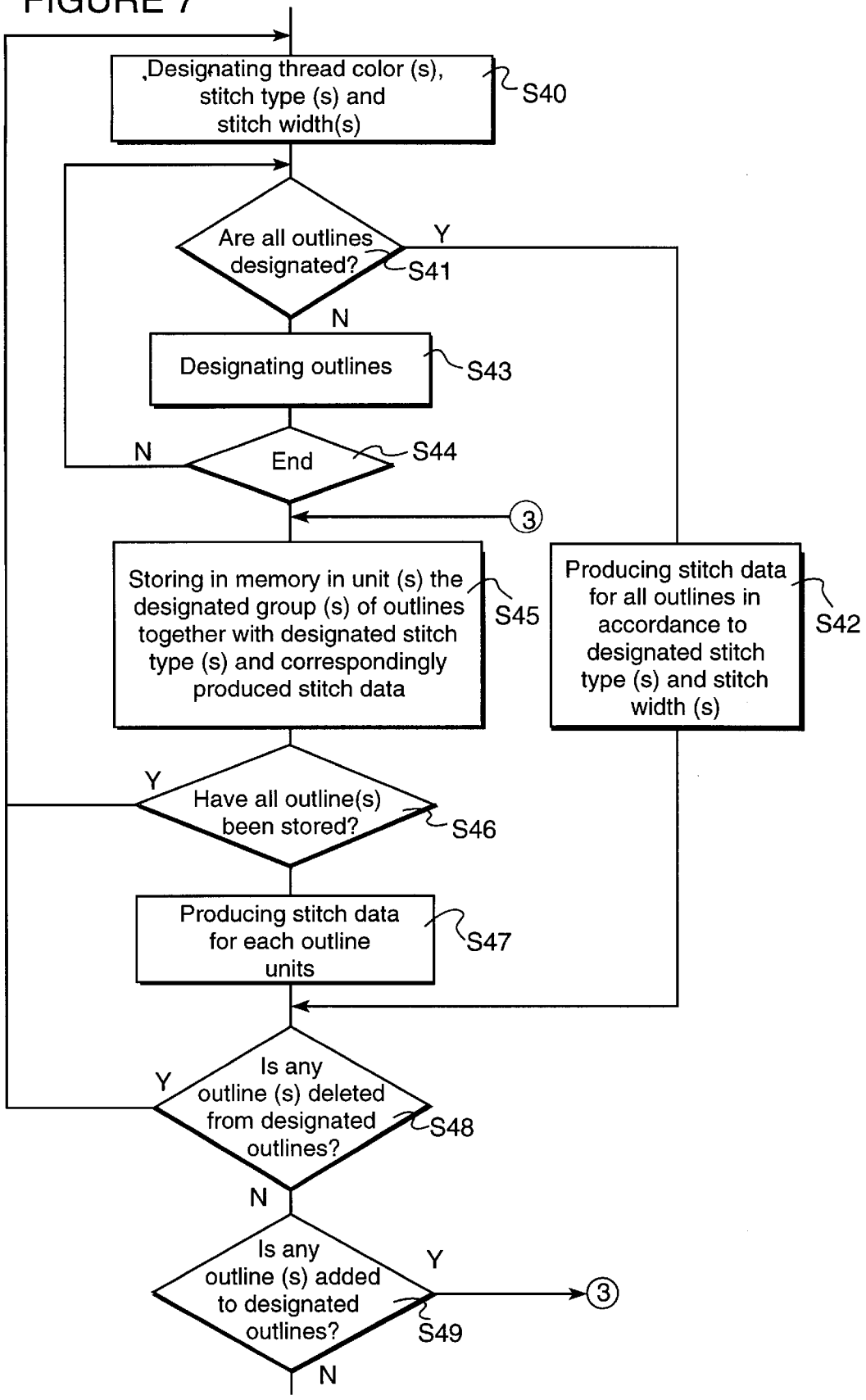
FIG. 7 is a flow chart showing the operations for setting stitch conditions and for designating the outlines of image according to the embodiment of the invention.

The operations of outline designations at steps S11 to S14 and steps S16 and S17 in FIG. 2 will now be described in reference to FIG. 7.

The thread colors, stitch types and stitch widths are designated by operation of an outline thread color/stitch type/stitch width designating section 13 (Step S40). In case, the entire outline designating section 11 is operated to designate the entire outlines (Step S41), the stitch data are produced in accordance with the stitch type and the stitch width designated to the entire outlines (Step S42).

In case, entire outlines are not designated at one time by operation of the entire outline designating section 11, the outline designating section 10 is operated to designate each of the groups of outlines (Step S43). When the designation of a group of outlines is finished (Step S44), the designated group of outlines is temporarily stored as a single unit together with the designated thread color, stitch type and stitch width (Step S45). The same operation is repeated until all outlines are designated. When the designations of all outlines are finished (Step S46), the stitch data are produced for each of the groups of outlines (Step S47).

If the outline adding/deleting section 12 is operated to delete any embroidery conditions of an outline or outlines from the already designated embroidery conditions of outlines, the step is returned to the step S40, where the already designated embroidery conditions of outlines are so reset (Step S48). On the other hand, if the section 12 is operated to add any embroidery conditions of an outline or outlines to the already designated embroidery conditions of outlines, the step is returned to the step S45, where the already designated embroidery conditions of outlines are so reset, and then the stitch data are produced for the finally designated embroidery conditions of the groups of outlines (Step S49).

Thus, according to the embodiment of the invention, the user is able to indicate a color for a background at the display 40 which is same or closest to the color of the work on which an image is sewn, thereby to foresee the embroidery pattern to be actually stitched.

Since the color of background may be displayed before or after the image is read out, or before or after the stitch conditions are set, the operation efficiency is remarkably increased. Further the background area may be optionally designated to display the embroidery pattern in various ways.

Further since the color indicating data for optional colors may be registered to the color indication data registering section 22, the embroidery pattern may be easily displayed with the colors corresponding to the colors of the work and of the threads to be actually employed, and thus the user may foresee the embroidery pattern at the display before it is stitched.

Further the entire disclosure of Japanese Patent Applications No. 9-252640 filed on Sep. 3, 1997, and No. 9-309562 filed on Oct. 24, 1997, including specification, claims and summary are incorporated herein by reference in their entirety.

What is claimed is:

1. An embroidery stitch data producing device for producing stitch data in accordance with the image information substantially comprising:

display means for indicating thereat an image in connection with said image information;

means for setting an area of background corresponding to an object which is to be embroidered at said display means;

color designating means for designating a color of said area of background displayed at said display means; and control means for controlling said display means to give said designated color to said area of background.

2. The device as defined in claim 1, further comprising first background setting means for setting as said area of background the area of said display other than the area being occupied by said image.

3. The device as defined in claim 1, further comprising second background setting means for setting the entire area of said display as said area of background when said image is not indicated at said display.

4. The device as defined in claim 3, wherein said background setting means is adapted to partly delete said entire area of said display in connection with said image when said image is indicated at said display.

5. The device as defined in claim 1, further comprising means for optionally setting said area of background.

6. An embroidery stitch data producing device substantially comprising:

means for giving an image which is composed of a plurality of outlines and blocks;

display means for indicating said image thereat;

first designating means for designating stitch conditions including the colors of threads which may be used to embroider said outlines and said blocks;

second designating means for designating the outlines and blocks to be embroidered with said stitch conditions;

means for setting as an area of background corresponding to an object which is to be embroidered the area of said display other than the areas occupied by said outlines and blocks designated by said second designated means;

color designating means for designating a color of said area of background displayed at said display means; and control means for controlling said display means to indicate thereat said area of background with said designated color.

7. The device as defined in claim 1, wherein said color designating means includes at least one of color information for a plurality of colors, means for producing color and means for inputting color information.

8. An embroidery stitch data producing device substantially comprising:

means for giving an image;

display means for indicating said image thereat;

designating means for designating a color to be indicated at said display means;

means for giving color indicating data for the color designated by said designating means;

control means for controlling said display means to indicate thereat said color in accordance with said color indicating data; and means for registering optional colors thereto;

wherein said designating means can designate selectively the colors registered in said color registering means.

9. The device as defined in claim 8, further comprising means for producing color indicating data for optional colors, wherein said color registering means is adapted to register said color indicating data thereto.

10. The device as defined in claim 8, further comprising means for optionally reading in colors, wherein said color registering means is adapted to register thereto the color indicating data for the colors which are read in by said color reading means.

11. The device as defined in claim 8, further comprising means for memory means for storing therein color indicating data for indicating predetermined colors, wherein said color registering means is adapted to register said color indicating data thereto.

12. Recording means for storing therein programs for producing stitch data in accordance with image data, said programs being read by a computer and comprising the steps of:

inputting image data from an image;

displaying said image in accordance with said image data;

setting an area of background corresponding to an object which is to be embroidered at a display means:

designating a color for said area of background displayed at said display means; and giving said designated color to said area of background at said display means.

* * * * *